US005376022A

United States Patent [19]

Carr et al.

[11] Patent Number: 5,376,022

[45] Date of Patent: Dec. 27, 1994

[54] ELECTRICAL CONNECTOR

[75] Inventors: Francis L. Carr, Downers Grove; George P. Canell, Schaumburg, both of Ill.

[73] Assignee: Safco Corporation, Chicago, Ill.

[21] Appl. No.: 161,601

[22] Filed: Dec. 6, 1993

[51] Int. Cl.[5] ..... H01R 17/18

[52] U.S. Cl. ..... 439/668; 439/677; 439/736

[58] Field of Search ..... 439/668, 669, 675, 677, 439/680, 598, 736

[56] References Cited

U.S. PATENT DOCUMENTS

| | | | |
|---|---|---|---|
| 2,576,174 | 11/1951 | Denine | 439/668 |
| 4,790,776 | 12/1988 | Iijima | 439/736 |
| 5,062,807 | 11/1991 | Guss, III | 439/736 |
| 5,224,879 | 7/1993 | Mullins et al. | 439/736 |

FOREIGN PATENT DOCUMENTS

| | | | |
|---|---|---|---|
| 0310718 | 4/1989 | European Pat. Off. | 439/668 |

*Primary Examiner*—David L. Pirlot

*Attorney, Agent, or Firm*—Augustus G. Douvas

[57] ABSTRACT

An electrical coaxial jack connector adapted for electrical interconnection with a mating plug-type coaxial connector. The coaxial jack connector has an integral molded plastic body from which external connecting wires project to form a unitary cable connector. The jack-connector body is subdivided into three body sections, namely, a contact-housing section, a grip section, and a wire strain-relief section. A contact mounting board divides the contact-housing section from the grip section. A coaxial male-pin contact and a peripheral leaf-spring contact project from a front surface of the mounting board into an access cavity defined by a cylindrical wall which forms the contact-housing body section. This cylindrical wall is formed with an internal recess or groove which is located adjacent to and in alignment with the leaf-spring contact. This recess serves as a receptacle, at least in part, for the leaf-spring contact in response to leaf-spring deflecting movements caused by the mating insertion of a plug coaxial connector into the jack connector-housing body section.

5 Claims, 2 Drawing Sheets

ELECTRICAL CONNECTOR

This invention relates to electrical connectors which are commonly known commercially as jack-type coaxial connectors.

BACKGROUND OF THE INVENTION

The prior art is prolific in electrical connectors of many diverse designs used in a large variety of different applications. One major category of such connectors is termed coaxial connectors. These connectors are usually employed in coupled pairs to establish a desired electrical connection. In general, one connector of each connecting pair employees a male element or pin that is coaxially aligned with a female element or pin.

In some designs, a coaxial connector may employ a metal body that is electrically conductive; in other instances the body may be fabricated from a plastic material. The connectors may also be panel mounted, or integrally attached to individual wires, or to a cable containing several wires.

In recent times, with the introduction of low-voltage electronic circuitry employing semiconductor elements, such as, transistors, integrated circuits and light-emitting diodes, coaxial cable connectors have become commonplace. In inexpensive applications, these connectors are used to establish low-voltage cable interconnections between circuit subsystems or components. Accordingly, the coaxial connectors are cheaply constructed resulting in poor tolerances between mating coaxial elements that result in unreliable connections both mechanically and electrically. In particular, the individual connections of a poorly constructed mated set will pull apart easily, or a male pin will fit loosely within a mated female pin resulting in an intermittent noisy connection.

SUMMARY OF THE INVENTION

Accordingly, a principal object of this invention is to provide a jack-type coaxial connector which is simple in design that may be easily and inexpensively manufactured, but which will nonetheless establish both a reliable electrical and mechanical connection with a mating plug-type coaxial connector.

Another object of the invention is to provide an improved jack-type coaxial connector having a unitary molded plastic body from which external connecting wires emanate to form a cable connector.

A preferred embodiment of the coaxial jack connector of this invention incorporates an insulating mounting board subassembly which includes a coaxially supported male-pin contact and a non-coaxial, resilient leaf-spring contact projecting from a mounting board. A pair of connecting wires are individually attached to the male-pin contact and the leaf-spring contact at the rear of the mounting board. A plastic body of insulating material is molded to envelope and house the mounting board, its supported contacts and the external connecting wires.

The plastic body is formed with an access cavity which houses the male-pin contact and the leaf-spring contact which project into the cavity. The inside body wall defining the body adjacent to the leaf-spring contact is formed with a recess or groove which is aligned with the leaf-spring contact. This recess serves as a receptacle for receiving at least in part the leaf-spring caused by the insertion of a coaxial plug connector having a female-pin contact into the cavity of the jack connector of this invention. The force exerted by the leaf-spring contact against the mating male and female contacts assures a reliable mechanical and electrical connection between the two mating plug and jack coaxial connectors.

DESCRIPTION OF THE DRAWINGS

In order that all of the structural features of the electrical connector of this invention, and its method of manufacture may be readily understood, reference is made to the accompanying drawings wherein.

DETAILED DESCRIPTION OF THE PREFERRED EMBODIMENT

Figure 1:
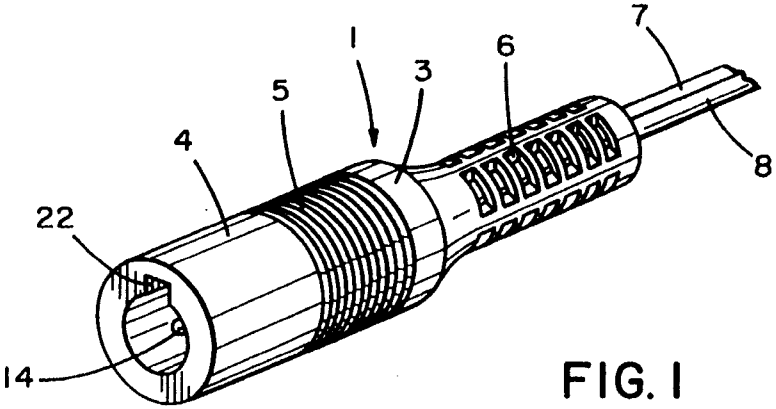
FIG. 1 is an isometric view of the coaxial-jack electrical connector of this invention.
Figure 4:
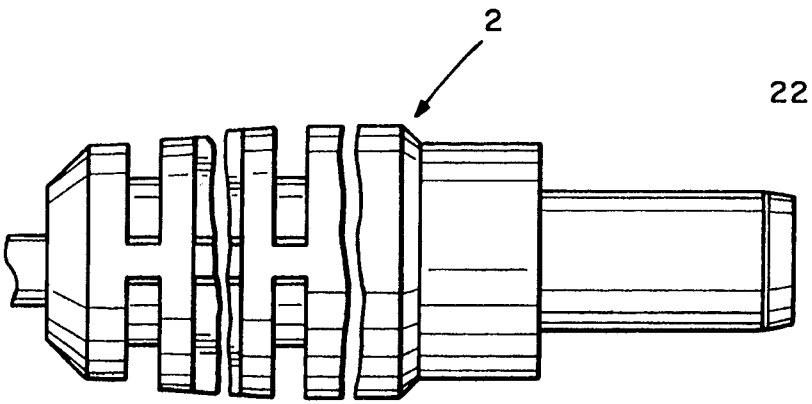
FIG. 4 is a view of a typical plug electrical connector ready for mating assembly with the jack electrical connector of FIG. 3.
Figure 8:
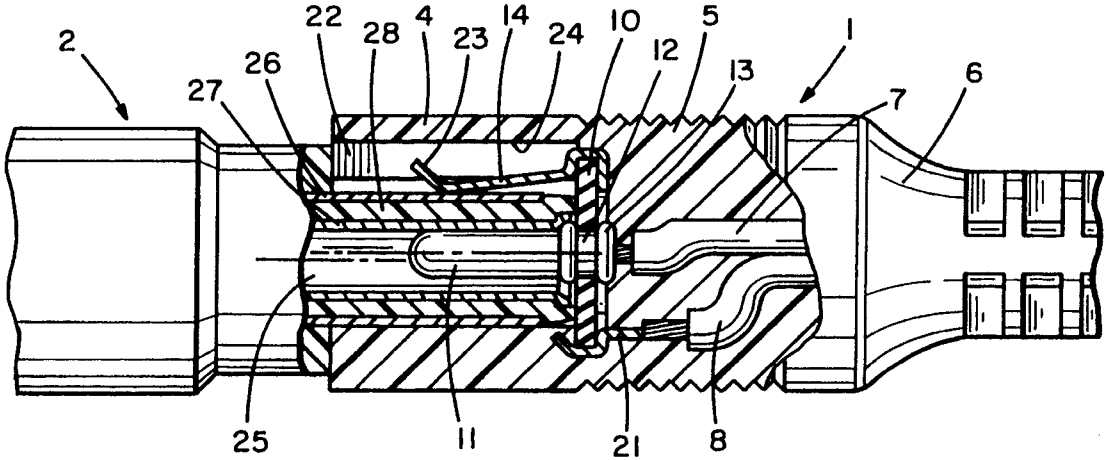
FIG. 8 is a view in partial broken-away section which shows the mating connection of the jack and plug electrical connectors with the male and female contact pins in substantial coaxial alignment.

The electrical connector 1 of this invention (FIG. 1) is referred to commercially as a molded coaxial power jack. Its principal function is to establish a two-conductor electrical interconnection when jack connector 1 is coupled to a mating coaxial power-plug connector 2 (FIG. 4) as is shown in FIG. 8. These coaxial plug-jack connector sets are typically employed in low-voltage applications; and the mating plug connectors may take a variety of forms, for example, either a straight line or a right angle configuration. Plug connector 2 is of a straight-line configuration. Plug connector 2 is of a straight-line configuration merely for representation purposes.

Figure 2:
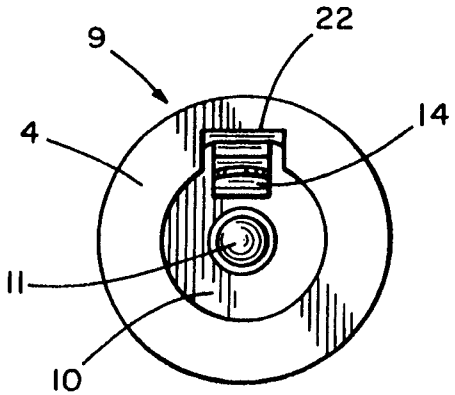
FIG. 2 is a front view of the jack electrical connector which shows the access opening to the contact housing section and the male-pin contact and the leaf-spring contact located within this housing section.
Figure 3:
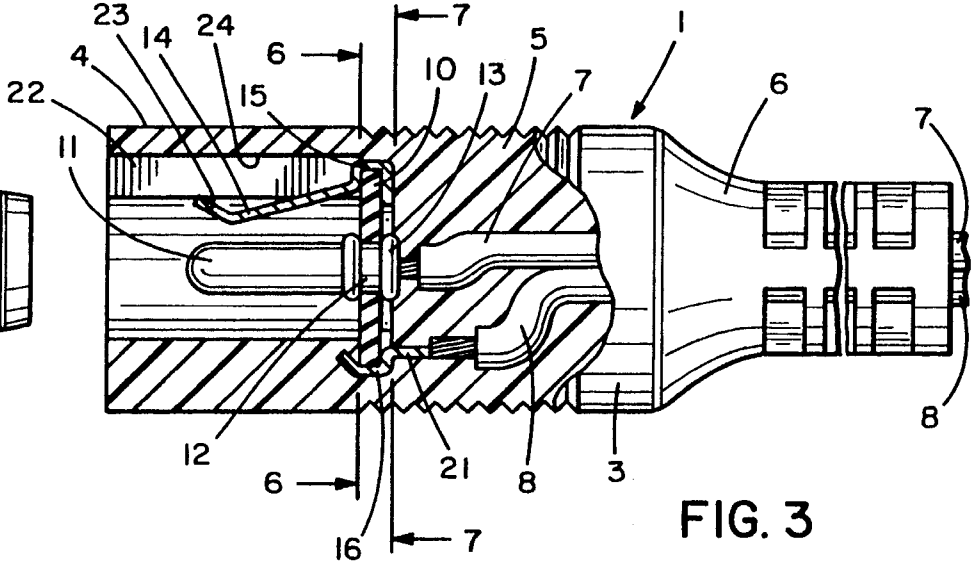
FIG. 3 is a view of the jack electrical connector in partial broken-away section which shows the internal construction of the contact mounting-board subassembly.

Jack connector 1 has a unitary, molded body 3 which is satisfactorily fabricated from a polyvinylchloride plastic. Body 3 may be considered as being subdivided into three plastic body sections which are joined (FIG. 3), namely, a contact-housing section 4, a manual gripping section 5, and a strain-relief section 6 from which a pair of insulated external connecting wires 7 and 8 project.

A principal novel feature of the invention resides in the construction of contact mounting-board subassembly 9 (FIGS. 2, 3, 4, 5). Contact mounting board subassembly 9 (FIG. 5) comprises a disc-like mounting board 10 satisfactorily fabricated from a phenolic plastic insulation material. Male-pin contact 11 is staked to the center of the board. A portion 12 of the shank of male-pin contact passes through board 10 (FIGS. 3 and 8) and is fastened at the rear of board 10 by a metallic ring 13 formed by crimping or staking the end of the male-pin contact. Male-pin contact 11 is satisfactorily fabricated from a nickel-plated brass.

Figure 7:
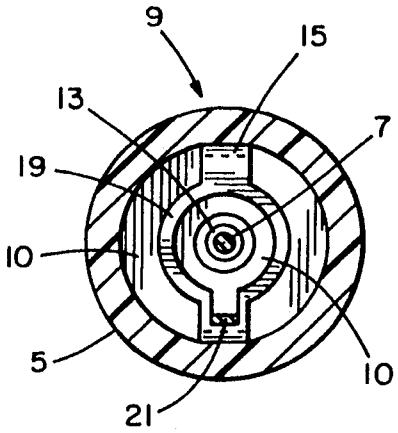
FIG. 7 is a section view taken along line 6—6 of FIG. 3 which shows a rear view of the insulator mounting board assembled within its jack connector body.
Figure 6:
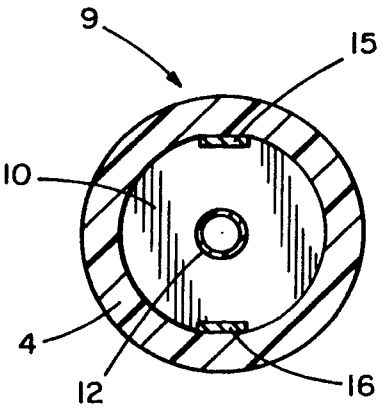
FIG. 6 is a section view taken along line 6—6 of FIG. 3 which shows a front access view of the insulator mounting board assembled within its jack connector body.
Figure 5:
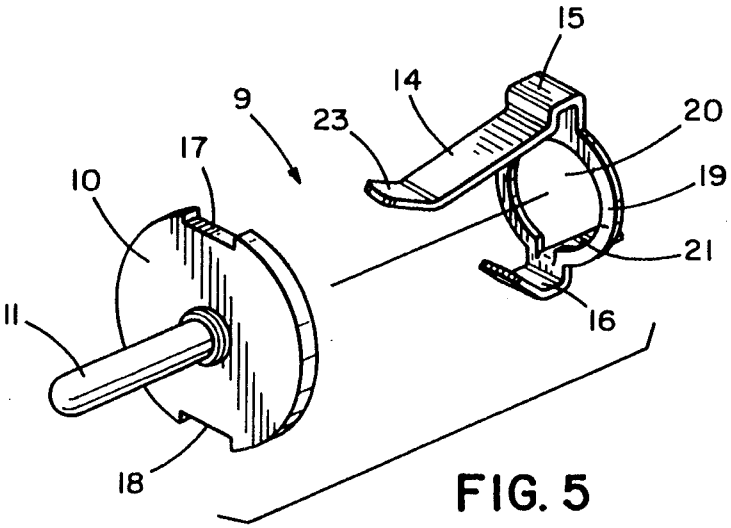
FIG. 5 is an exploded view which shows the leaf-spring contact removed from its insulator mounting board, but with the male-pin contact supported on the mounting board.

Leaf-spring contact 14 (FIG. 5) is formed with a pair of locking channel-like elements 15 and 16 which are seated and locked to mounting-board notches 17 and 18, respectively. Elements 15 and 16 are joined together by an electrical-conducting connecting ring 19 which is affixed to the rear surface of mounting board 10. A central circular opening 20 (FIG. 5) is defined by connecting ring 19 (FIG. 7) so that male-pin contact 11 and leaf-spring contact 14 are not electrically shorted on the rear surface of mounting board 10. An electrical-connection lug 21 projects from the rear of conducting ring 19. External connecting wire 8 is soldered to lug 21.

Contact-housing section 4 is formed with a generally cylindrical construction (FIGS. 1 and 2) having a uniform wall thickness, except that this uniformity in wall thickness is reduced by an elongated or recess groove 22 (FIGS. 1, 2, 3, and 8) formed on the interior surface of the wall adjacent to and aligned with leaf-spring contact 14. This recess groove extends to locking element 15 and serves as a receptacle for leaf-spring contact 14 when plug connector 2 is mated with jack connector 1 (FIG. 8). Recess 22 serves to project leaf-spring contact 14 against mechanical distortion; and when projecting lip 23 of leaf-spring contact 14 contacts conductor sleeve 26 of female-pin contact 25 (FIG. 8), the force exerted by leaf-spring contact 14 against female-pin contact 25 of plug connector 2 establishes a firm and reliable electrical connection between both the male and female contacts. Inner wall 24 of recess groove 22 serves as limit stop for projecting lip 23.

Female-pin contact 25 is formed with two cylindrical metallic conductor contact sleeves 26 and 27 joined to and separated by an insulating cylinder 28. Leaf-spring contact 14 connects to female contact sleeve 26 and male-pin contact 11 connects to female contact sleeve 27.

While jack connector 1 and plug connector 2 are designated commercially as coaxial connectors; in reality the axes of both connectors are usually misaligned by a few thousandths of an inch in order to assure easy and reliable mating connection of the two connectors. In a typical construction male-pin contact 11 has a diameter of 0.078 inch and the bore of female contact sleeve 27 has a diameter of 0.080 inch. This 0.002 thousandth inch misalignment assures that male-pin contact 11 is easily insertable within female contact sleeve 27. The spring force exerted by leaf-spring contact 14 overcomes any misalignment looseness and establishes a reliable connection.

The inclusion of recess groove 22 enable jack connector 1 to be fabricated in a relatively smaller size and still accommodate a greater range of plug connector 2 sizes. This advantage is attainable because of the greater range of deflection provided by recess groove 22 for leaf-spring contact 14.

Jack connector 1 is also easy to assemble and accordingly, is economical to manufacture. In the fabrication of jack connector 1, initially contact mounting-board subassembly 9 is assembled and connecting wires 7 and 8 are soldered or banded to male-pin contact 11 and lug 21. Thereafter, this assembly of components is placed in an appropriate mold form and the wired contact mounting-board subassembly is enveloped by and locked firmly and reliably to its plastic housing in a simple molding operating.

Gripping section 5 and strain-relief section 6 are of conventional construction.

It should be understood that the above-described preferred embodiment may be modified without departing from the scope of the invention.

What is claimed is:

1. An electrical connector having a male-pin contact of a generally circular cross section and a resilient leaf-spring contact adapted for interconnection with a mating connector having a female-pin contact formed by two cylindrical contact sleeves separated by an insulating sleeve to define an internal bore of a generally circular cross section adapted to serve as a socket for the male-pin contact and in which the electrical connector comprises an integral insulated body having an electrical-contact housing body section defined by a generally uniform cylindrical wall which forms a generally circular bore that is modified by an elongated groove extending generally the length of the interior surface of the cylindrical wall with the grooved housing body section defining an access bore with an opening for receiving by insertion the female-pin contact, a contact mounting board of electrical insulating material fixed within the access bore of the housing body section transverse to the longitudinal axis of the housing body section to serve as an end wall for the access bore of the housing body section, a centrally-disposed male-pin contact supported on and projecting generally perpendicularly from the mounting board towards the opening of the access bore, an electrical-conducting connecting ring seated on a rear surface of the mounting board and positioned away from the access bore with the ring enveloping but separate from the portion of the male-pin contact supported on the mounting board and a resilient leaf-spring contact integrally attached to the periphery of the mounting ring and also supported on the mounting board and electrically isolated and physically separated from the male-pin contact and projecting towards the access opening with the leaf-spring contact being positioned adjacent to and in physical alignment with the elongated groove and with the groove serving as a close-fitting receptacle for receiving at least in part the leaf-spring contact in response to leaf-spring deflecting movements caused by the mating connection of the male and female pin contacts of the two connectors by which the outer sleeve of the female pin-contact forces the leaf-spring towards and at least partially into the grove.

2. The electrical connector of claim 1, in which the integral insulated body comprises, in addition to the electrical-contact housing body section, a manual grip section fixed to the housing body section with the contact mounting board dividing and separating the two body sections, and a pair of electrical connector wires extending through the manual grip section to connect with the male-pin and leaf-spring contacts supported on the contact mounting board.

3. The electrical connector of claim 2 in which the integral insulated body comprises, in addition to the electrical-contact housing body section and the manual grip section, a strain relief section joining the manual grip section with the pair of electrical connection wires extending through the strain relief section.

4. The electrical connector of claim 3 in which the integral insulated body is molded to and envelopes the mounting board and the two electrical connector wires.

5. In an electrical connector having a male-pin contact of a generally circular cross-section and an elongated resilient leaf-spring contact housed within a connector body section formed with a tubular wall defining a cavity for containing both contacts and having a cavity access opening for establishing external electrical connection to both the male-pin and the leaf-spring contacts by an insertable female-pin contact formed by two cylindrical contact sleeves separated by an insulating sleeve to define an internal bore of generally circular cross-section, the improvement comprising a contact mounting board fabricated of electrical insulating material fixed within the cavity and serving as an end wall for the cavity with both contacts supported on the mounting board to extend into the cavity, and an elongated narrow recess modifying the tubular wall to form an elongated opening communicating with the cavity and with the recess being located adjacent to and in general alignment with the leaf-spring contact so that the recess serves as a close-fitting receptacle for receiving at least in part the leaf-spring contact in response to leaf-spring deflecting movements caused by the establishment of electrical connections by the female-pin contact to the male-pin contacts through the access opening of the cavity.

* * * * *